United States Patent [19]

Sluys

[11] 4,300,854

[45] Nov. 17, 1981

[54] MOVABLE FLOAT SYSTEM FOR BOAT LAUNCHING RAMPS

[75] Inventor: Wesley W. Sluys, Bellingham, Wash.

[73] Assignee: Builders Concrete, Inc., Bellingham, Wash.

[21] Appl. No.: 136,308

[22] Filed: Apr. 1, 1980

[51] Int. Cl.[3] ..... B63C 3/00

[52] U.S. Cl. ..... 405/1; 405/2; 405/219

[58] Field of Search ..... 405/1, 2, 3, 86, 92, 405/219; 9/1.2; 114/44, 45, 263

[56] References Cited

U.S. PATENT DOCUMENTS

| | | | |
|---|---|---|---|
| 1,320,180 | 10/1919 | Short | 405/2 |
| 3,088,287 | 5/1963 | Berry | 114/263 X |
| 3,736,898 | 6/1973 | Yamura | 114/45 |
| 3,916,811 | 11/1975 | Fromnick et al. | 114/45 X |

FOREIGN PATENT DOCUMENTS

| | | | |
|---|---|---|---|
| 334944 | 3/1921 | Fed. Rep. of Germany | 405/1 |
| 1532495 | 6/1968 | France | 405/1 |
| 664872 | 5/1979 | U.S.S.R. | 405/1 |

*Primary Examiner*—David H. Corbin

*Attorney, Agent, or Firm*—Seed, Berry, Vernon & Baynham

[57] ABSTRACT

A float movable along a ramp for launching trailerable boats so that the float remains adjacent the water line of the ramp responsive to changes in water level. The float is moved by a line extending from the deep water end of the float, downwardly to a stationary underwater sheave, upwardly to a shore mounted powered drive mechanism and downwardly to the shallow water end of the float. The drive mechanism is controlled by a water level sensor to move the float along the ramp as the water level changes so that the float remains in the water near the water line of the ramp as the water level fluctuates. The water level sensor includes an ultrasonic level detector mounted in a vertical tube communicating with the water through an equalizing tube. The float moves along a guide mechanism running alongside one end of the ramp to prevent transverse movement of the float.

13 Claims, 9 Drawing Figures

FIG. 1A
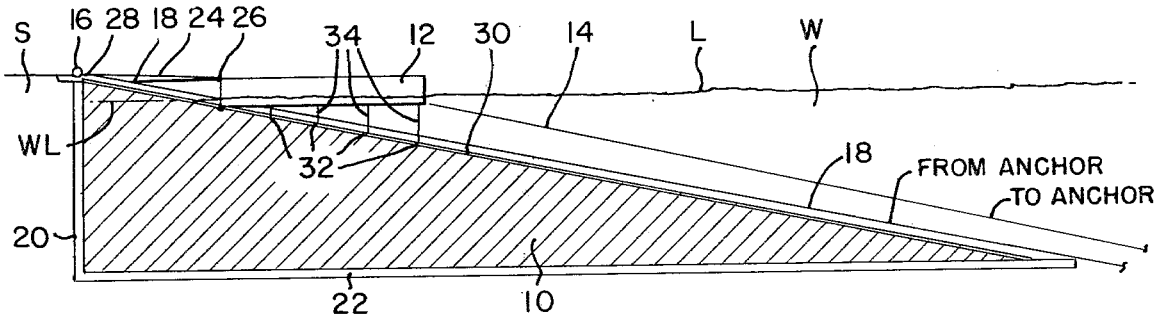
FIG. 1B
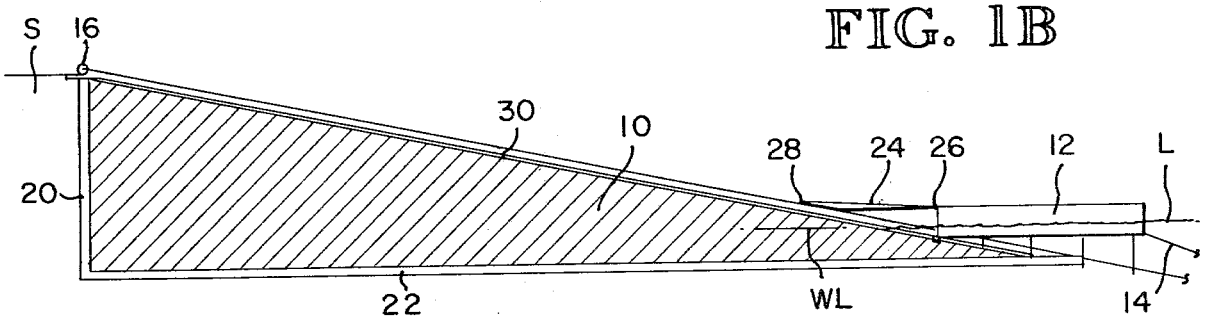
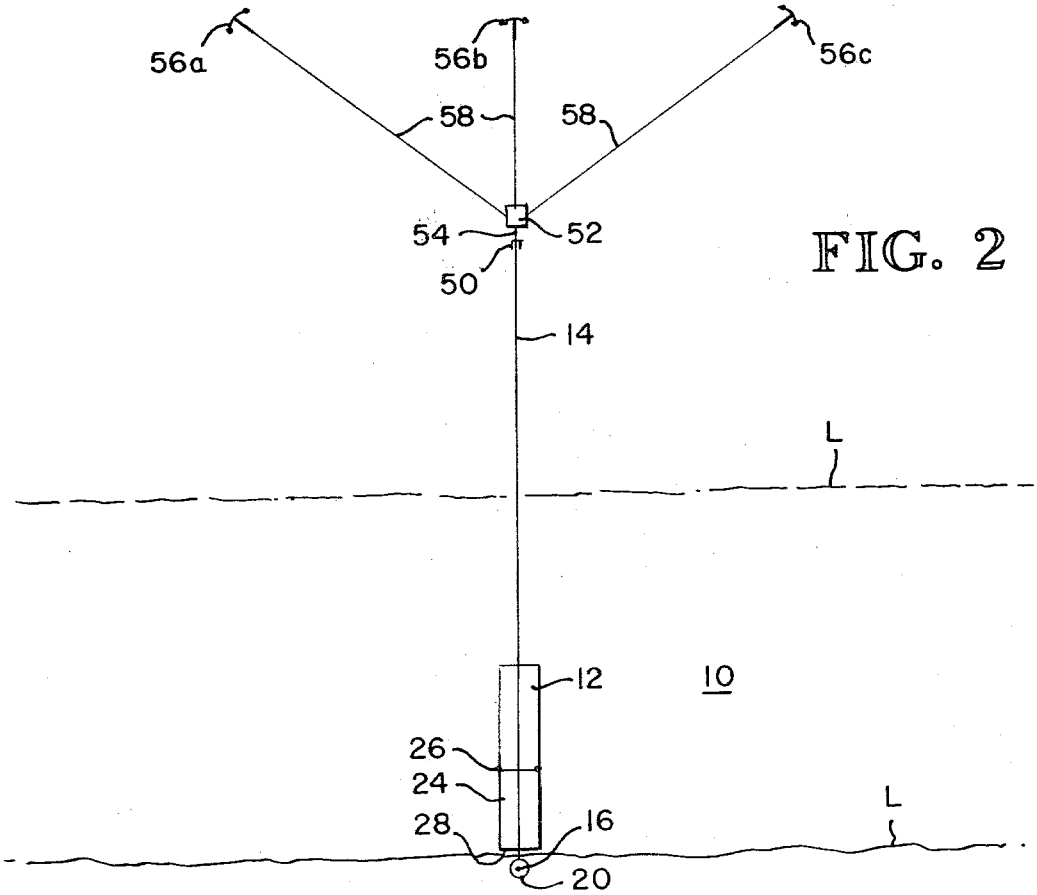
FIG. 2

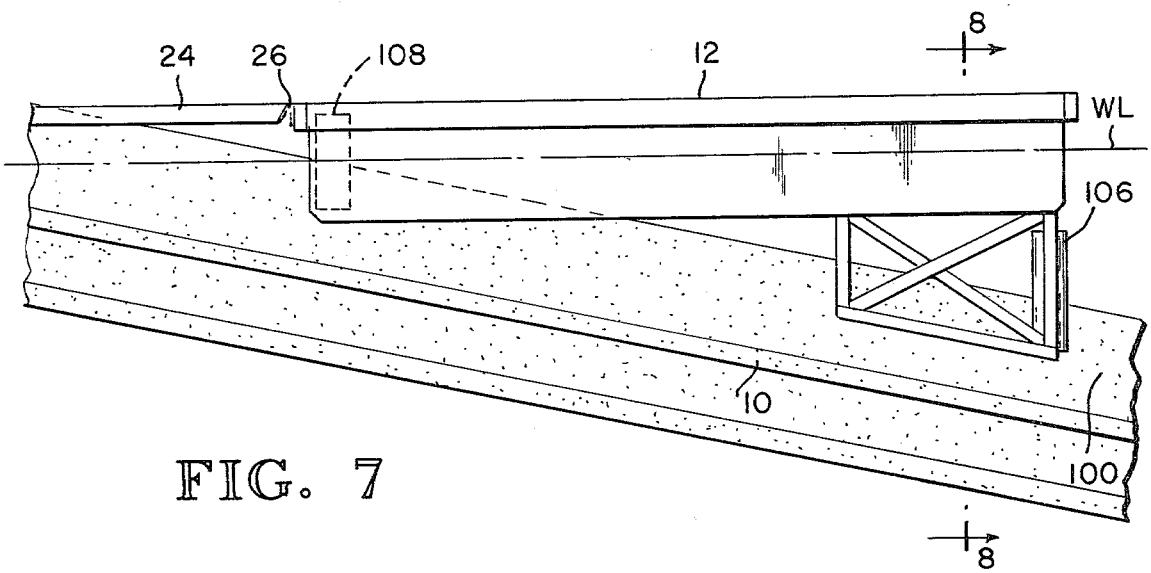
FIG. 7
FIG. 8
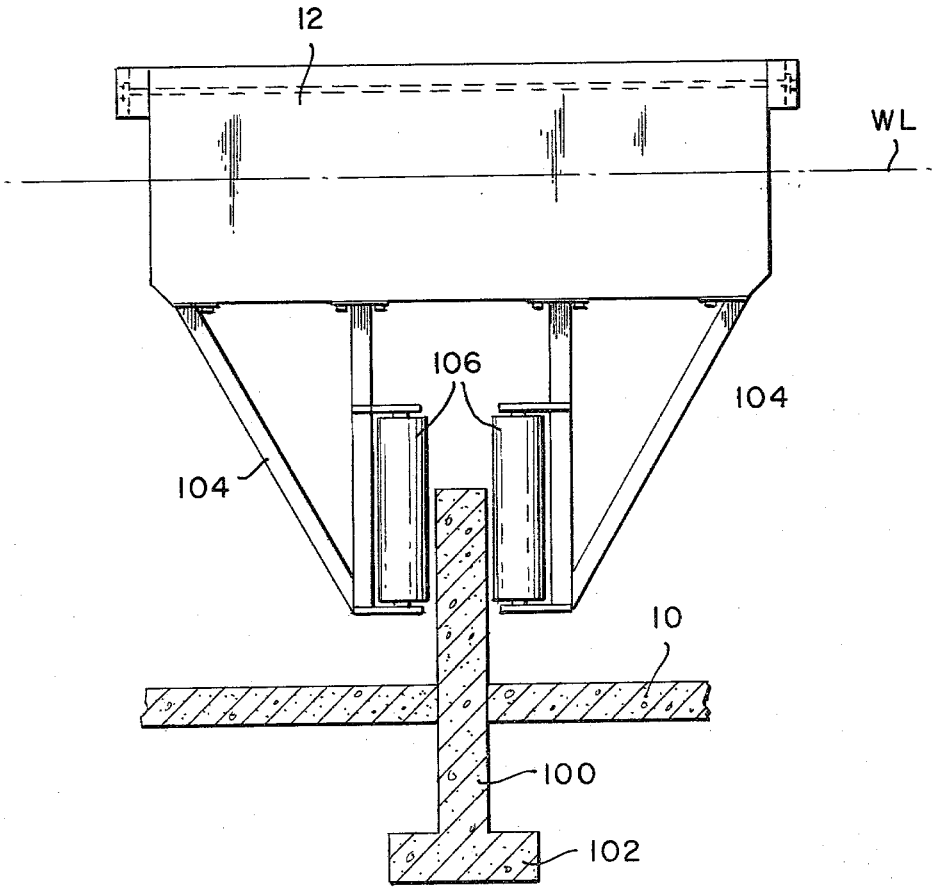

MOVABLE FLOAT SYSTEM FOR BOAT LAUNCHING RAMPS

BACKGROUND OF THE INVENTION

1. Field of the Invention

This invention relates to boat launching facilities for trailerable boats, and more particularly to a movable flat on which an individual stands while launching a boat.

2. Description of the Prior Art

Boats of either the motorized or sailing variety are commonly carried from place to place on trailers which are towed by motorized vehicles. These trailerable boats are generally placed into a body of water by backing the trailer down an inclined launching ramp into the water, releasing the boat from the trailer and then driving the vehicle forwardly up the ramp to remove the trailer from the water. When the boat is to be removed from the water, the reverse procedure is followed.

During a boat launching or removal operation it is often necessary to manipulate the boat from the side, necessitating that the boater step into the water adjacent the boat. This technique is undesirable since the boater's clothing often becomes wet and the water may be uncomfortably cold. Furthermore, it is sometimes difficult to adequately maneuver the boat while standing in water well below the deck of the boat, particularly where the boat is large, the wind is heavy, or the surface of the water is rough.

To alleviate the problem of wading in the water to launch a boat, floats have been used in connection with loading ramps to allow boaters to stand on the float adjacent the boat during a launching or removal operation. This technique is adequate where the water level does not fluctuate substantially so that the water line at the ramp is fairly constant. However, where inclined launching ramps are used with bodies of salt water or lakes having widely fluctuating water levels, the water line of the ramp fluctuates accordingly. Since the float should be positioned in the water closely adjacent the water line of the ramp, it is necessary to move the float along the ramp or to otherwise compensate for water level variations. Two techniques have been employed to accomplish this function.

The most commonly used technique for compensating for water level variations is to pivotally interconnect a number of floats so that the floats are successively grounded as the water level falls, yet sufficient numbers of floats are provided so that at least some of the floats are always floating. This technique may be satisfactory for bodies of water in which the water level does not fluctuate appreciably. However, for widely fluctuating water levels the number of floats required to compensate for water level variations is unacceptably large. Also, it is difficult to adequately prevent transverse movement of a large number of pivotally interconnected floats where only the inner float is connected to a ramp. In order to allow single floats to be used with ramps for launching boats into a body of water in which the water level fluctuates a great deal, mechanisms have been tried for moving the float in accordance with the variations in water level. However, such devices use either the buoyancy of the float or a counterweight to move the float up the ramp when the water level increases, and gravity acting on either the float or a weight to move the float down the ramp when the water level falls. Movable float systems utilizing this technique have not functioned acceptably, principally because the forces of buoyancy and gravity must continually move the float up the ramp as the water level rises, or down the ramp as the water level falls.

This angular movement causes severe binding action which quickly overcomes the floats buoyancy reserves or gravity forces thus immobilizing the float.

SUMMARY OF THE INVENTION

The principal object of the invention is to provide a single float which automatically moves along a boat launching ramp responsive to water level variations so that the float remains near the water line of the ramp.

It is another object of the invention to provide a device for measuring the water level at a boat launching ramp which does not contact the water and which inherently filters higher frequency level fluctuations such as waves.

It is still another object of the invention to provide a mechanism for guiding a float along an inclined boat launching ramp to prevent transverse movement of the float.

These and other objects of the invention are accomplished by connecting the opposite ends of an elongated float to a flexible line which extends downwardly along the ramp to a stationary underwater sheave, up the ramp to a shore mounted powered drive means to selectively drive the line in either direction and back to the float. The drive means is controlled by a water level sensor which generates appropriate signals responsive to variations in the water level adjacent the ramp. Transverse movement of the float may be prevented by a guide means extending along the ramp which the float slidably engages. The water level sensor is preferably a tube having a lower end positioned below the low water point and an upper end positioned above the high water point. An ultrasound level sensor positioned at the upper end of the tube measures the level of the water in the tube to provide an indication of the water level at the ramp. The tube is preferably disposed in a substantially vertical position and it communicates with the water adjacent the ramp through an equalizing tube. The relatively narrow, long length of the equalizing tube substantially filters out high frequency fluctuations of the water level at the float caused by, for example, waves and boat wakes. The guide may take a variety of forms. The float may be connected to a plurality of rollers which slidably engage a rail running along the incline of the ramp. Alternatively, a rigid, upwardly projecting wall may extend along the incline of the ramp. A frame projecting downwardly from the underside of the float straddles the wall and a plurality of rollers rotatably mounted on the frame abuts opposite faces of the wall to allow the frame to freely slide along the wall.

The system preferably includes an access ramp extending from the shallow water end of the float to an exposed portion of the ramp. The access ramp is preferably pivotally secured to the end of the float, and its opposite end rests upon the ramp through a plurality of rotatably mounted wheels.

BRIEF DESCRIPTION OF THE DRAWINGS

FIGS. 1A and 1B are cross-sectional views of the movable float system illustrating the float in the high water and low water positions, respectively;

FIG. 2 is a top plan view of one embodiment of the movable float system;

FIG. 7 is a longitudinal cross-sectional view of another embodiment of the movable float system; and FIG. 8 is a cross-sectional view taken along the line 8—8 of FIG. 7.

DETAILED DESCRIPTION OF THE INVENTION

Figure 4:
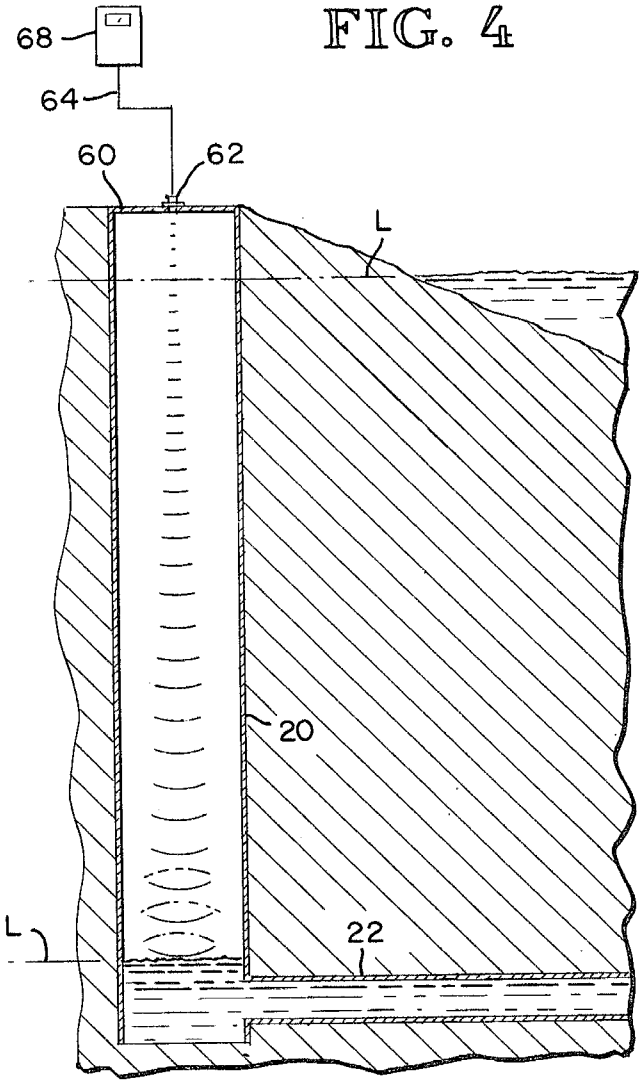
FIG. 4 is a cross-sectional view of the ultrasound level sensor used to control the position of the float along the ramp.

The movable float system as illustrated in FIG. 1A is adapted for use with an inclined launching ramp 10 for trailerable boats. The ramp 10 extends downwardly from the shoreline S into a body of water W which may have a level L that may fluctuate to some extent.

In normal use, a boat mounted on a trailer (not shown) is launched by backing the trailer into the water W and then releasing the boat from the trailer to allow the boat to float. Boaters position themselves in the water alongside the boat and maneuver the boat to a launching area such as floats or a pier adjacent the ramp. The boat is removed from the water by backing the empty trailer into the water W, winching the boat onto the trailer and then driving the trailer forwardly up the ramp 10. It is often necessary for the boaters to position themselves in the water to manipulate the boat as it is being placed onto the trailer.

In order to eliminate the need for boaters to enter the water to either maneuver or board the boat, a float 12 of conventional design is positioned to one or both sides of the ramp 10. A line 14 connected to the deep water end of the float 12 extends downwardly along the ramp 10 to stationary underwater sheave (shown hereinafter). The line 14 then extends upwardly along the float 10 to a shore mounted powered drive mechanism 16. The same line 14 or a different line 18 secured to the drive mechanism 16 extends downwardly from the power drive mechanism 16 to the shallow water end of the float 12. Energization of the powered drive mechanism 16 thus extends line 18 and retracts line 14, or retracts line 18 and extends line 14 to move the float 12 downwardly or upwardly, respectively, along the ramp 10.

As explained in greater detail hereinafter, the powered drive mechanism 16 is controlled by a level sensor so that the float 12 moves along the ramp 10 in accordance with the variation in the water level L so that the float 12 is maintained adjacent the water line WL of the ramp 10. Although a variety of water level sensors may be employed, the embodiment of FIG. 1 utilizes a sensor for measuring the level of water in a measurement tube 20 which communicates with the body of water W through an equalizing tube 22. The fairly long length of the equalizing tube 22 results in a time delay or averaging effect so that relatively high frequency variations in the water level L resulting from, for example, boat wakes, are filtered out. Consequently, the sensor for measuring the level of water in the measurement tube 20 responds only to fairly long-term variations in the level L of the water W. Other water level sensors which may be used include float type sensors or depth sensing devices mounted on either the float 12 or in the measurement tube 20.

The powered drive mechanism 16 in combination with the sensor for the measuring tube 20 may continually adjust the float 12 so that it is continuously positioned adjacent the water line WL of the ramp 10. However, it may be more desirable to incrementally adjust the position of the float 12 when the water level L reaches a number of predetermined positions. Utilizing this technique, the water level WL of the ramp 10 will, at time, be spaced apart somewhat from the shallow water end of the float 12 thereby making boarding of the float 12 difficult without wading into the water W. In order to make dry launching possible, an access ramp 24 is provided to bridge the water between the uphill edge of the float 12 and an exposed portion of the ramp. The ramp 24 is preferably pivotally secured to the float 12 at 26 and its uphill end rests upon the surface of the ramp 10 through a plurality of rollers 28.

As explained in greater detail hereinafter, under some circumstances it may be necessary to restrain transverse movement of the float 12. Accordingly, a rail 30 may extend along the incline of the ramp 10, and a plurality of roller means 32 engaging the ramp 30 may be connected to the float 12 by lines 34.

As the level L of water W recedes, as illustrated in FIG. 1B, the float 12 moves downwardly along the ramp 10 so that the deep water end of the float 12 remains adjacent the low water water line WL. In this position the access ramp 24 bridges the water between the uphill end of the float 12 and the water line WL with the rollers 28 mounted on the uphill end of the ramp 24 rolling along the ramp 10.

One embodiment of a mechanism for supporting the lines 14 which move the float 12 is illustrated in FIG. 2. Components of the system which are shown in FIG. 1 are identically numbered in FIG. 2 and are not explained in detail with respect thereto. The line 14 connected to the deep water end of the float 12 extends downwardly along the ramp 10 to a conventional underwater sheave 50. The sheave 50 is secured to a sinker 52 of sufficient weight by a line 54. The position of the sinker 52 is fixed by three anchors of conventional design 56 through respective lines 58. The embodiment of FIG. 2 differs from the embodiment of FIG. 1 in that a guide rail 30 is not provided with the embodiment of FIG. 2 to prevent transverse movement of the float 12. Instead, the tension of the lines 14, 18 is sufficient to prevent transverse movement of the float 12 since the transverse position of the anchor 52 is fixed by the outer anchors 56*a,c*. The guide rail 30 is generally required only where there are fairly strong side currents or side winds or where the ramp 10 is fairly narrow so that no transverse drifting of the float 12 is permissible. However, where a guide rail 30 is used, the outer anchors 56*a,c* are generally not required.

Figure 3:
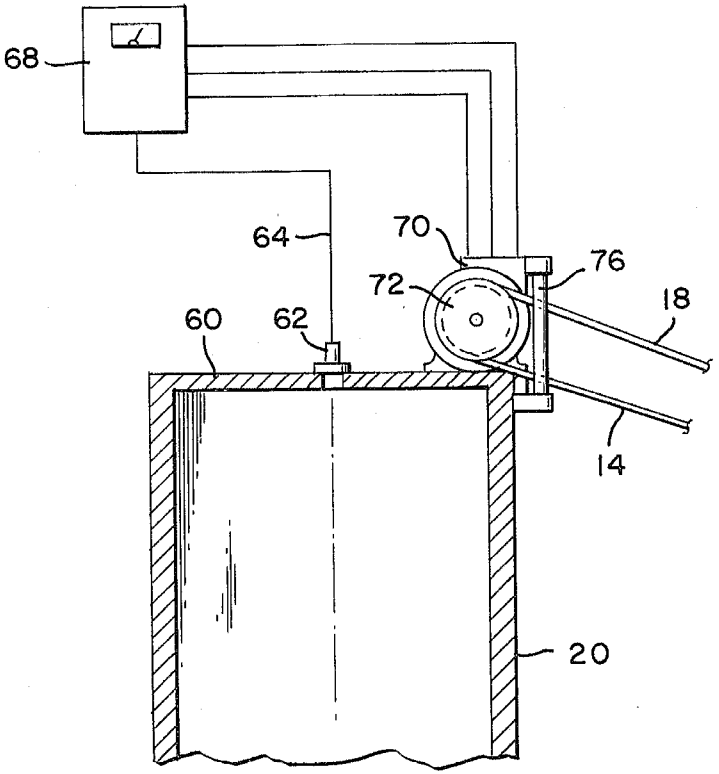
FIG. 3 is a side plan view of the movable float system illustrating the power drive means for moving the float along the inclined ramp and the upper portion of the ultrasound level sensor.

As mentioned above, movement of the float 12 along the ramp 10 is governed by the level L of the water W. Although a variety of level sensing devices may be employed, an ultrasound level sensor may be advantageously used since it does not directly contact the water which, in the case of salt water, can be quite corrosive. With reference, now, to FIGS. 3 and 4, the measurement tube 20 has a lower end positioned below the normal low water level L and an upper end positioned above the normal high water line L. The lower end of the measurement tube 20 communicates with the body of water W through the equalizing tube 22 as illustrated in FIG. 1. The upper end of the measurement tube 20 is enclosed by a cover 60 having a conventional ultrasound level sensing head 62 installed therein and pointing downwardly toward the lower end of the tube 20. The level sensing head 62 is connected by electrical leads 64 to conventional level sensing circuitry 68. The level sensing head 62 and associated circuitry 68 is a commercially available device sold by the Industrial Systems Division of WESMAR of Seattle, Wash. This device produces output signals whenever the level of a product beneath the sensor 62 reaches discrete pre-set levels. Thus, for example, appropriate signals may be generated whenever the water level rises by 4, 8, 12 and 16 feet above the low water level L. Utilizing this variety of discrete level sensing equipment, the float 12 moves in stages. For example, the float remains in its "8-foot" position until the level in the tube 20 rises to 12 feet above the low water level line L at which time the float 12 moves upwardly along the ramp 10 to its "12-foot" position. It is apparent that considerable water will be present between the uphill end of the float 12 and the water line WL (FIG. 1) of the ramp 10, thus making an access ramp 24 practically mandatory. The minimum length of the access ramp 24 is a function of the size of the increment between float moves. For example, a movable float system in which the float 12 moves after every 4 feet of level variation and in which the ramp has a 5:1 slope would require a 20-foot access ramp 24 to ensure that the rollers 28 are always above the water line WL.

The output of the control circuitry 68 energizes a conventional motor 70 in either of two directions depending upon the relationship between the present position of the float 12 and the present level L of the water W. The motor 70 includes an output shaft (not shown) which is connected to a split drum having two separate sections. With reference also, now, to FIG. 1, the cable 18 connected to the shallow water side of the float 12 is wound on one of the sections while the cable 14 connected to the downhill side of the float 12 via the sheave 50 is wound on the other section of the drum 72 in a direction opposite that of the cable 18. Consequently, rotation of the drum 72 in one direction extends cable 18 while retracting cable 14 to cause the float 12 to move downwardly along the ramp 10. Similarly, rotation of the drum 72 in the opposite direction retracts cable 18 and extends cable 14 to move the float 12 in the uphill direction. Other drive mechanisms may also be used. For example, a single line wrapped around a capstan may also suffice if an idler roller is provided to take up any line slack which may occur. In order to assure that the lines 14, 18 are wound on the proper sections of the drum 72 vertical guide rollers 76 are provided to fix the transverse position of the lines 14, 18 adjacent the drums 72.

Figure 5:
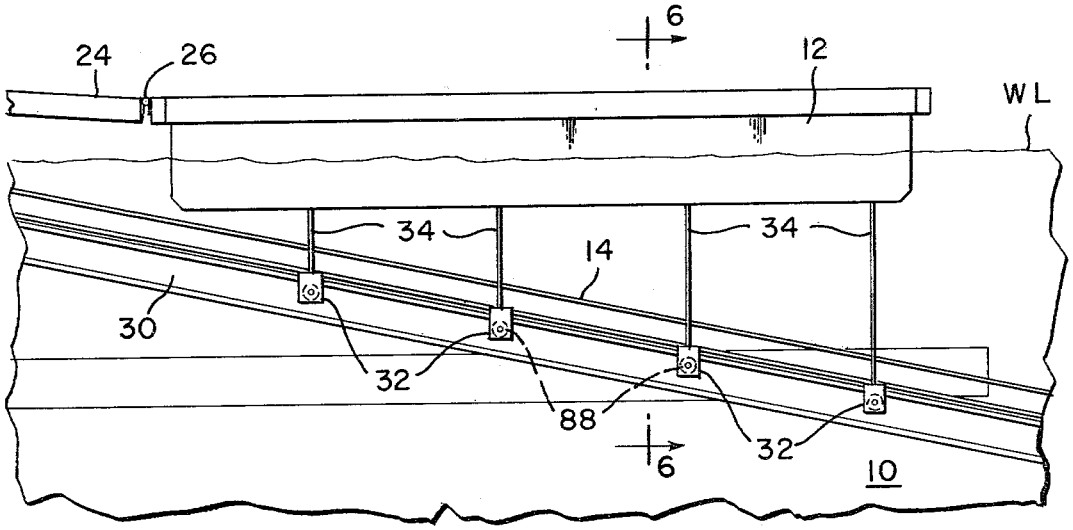
FIG. 5 is a longitudinal cross-sectional view illustrating one embodiment of the movable float system.
Figure 6:
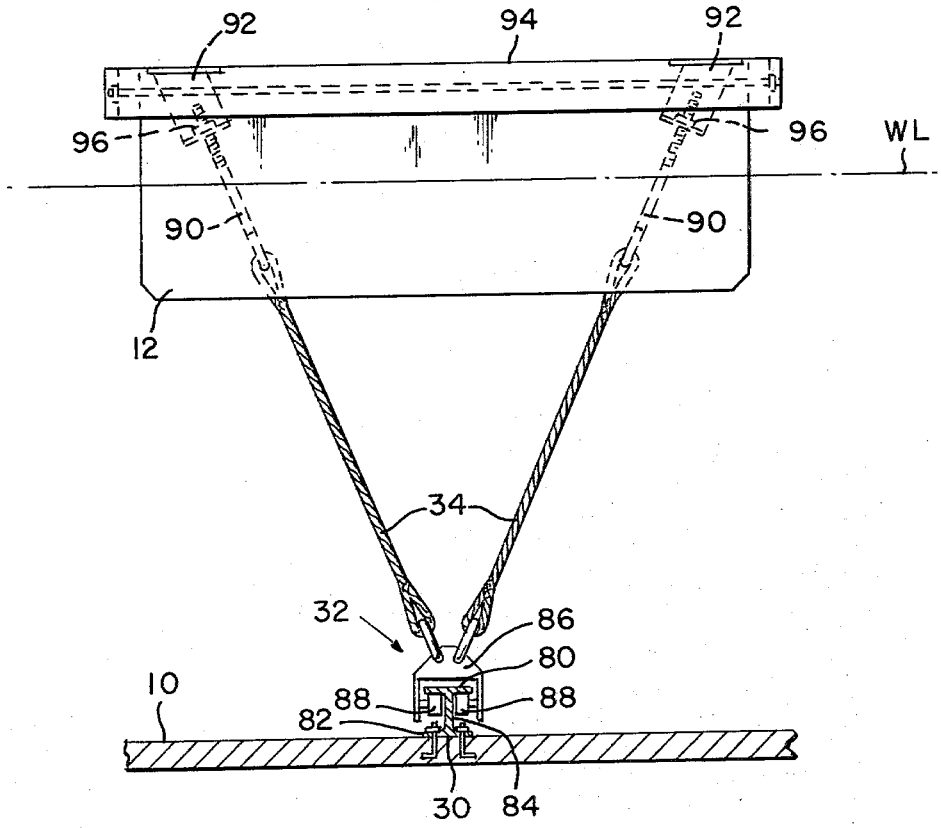
FIG. 6 is a cross-sectional view taken along the line 6—6 of FIG. 5.

As mentioned above, it is usually unnecessary to provide a guide mechanism for preventing transverse movement of the float 12. However, where cross-currents pass over the ramp 10 or where strong cross-winds are likely to move boats transversely into the float 12 and then transversly move the float 12, a guide mechanism can be advantageously used. The guide mechanism illustrated in FIG. 1 is illustrated in further details in FIGS. 5 and 6. The rail 30 is preferably an eye-beam cross-section as best illustrated in FIG. 6 having upper and lower flanges 80, 82, respectively interconnected by web 84. The roller assemblies 32 are composed of a trolley 86 straddling the rail 30 with a pair of guide rollers 88 rotatably mounted on opposite faces of the web 84. The peripheries of the guide rollers 88 contact the underside of the flange 80 so that the trolley can move along the length of the rail 30. The connector lines 34 are preferably formed of a resilient material such as nylon to accomodate shocks imparted to the float 12. The upper ends of the lines 34 are connected to conventional eye bolts 90 which are recessed in bores 92 beneath the deck 94 of the float 12. Nuts 96 engage the threaded ends of the eye bolts 90 in order to adjust the tension of the lines 34.

An alternative drive structure for preventing transverse movement of the float is illustrated in FIGS. 7 and 8. In this embodiment a vertical wall 100 having a footing 102 projects upwardly through the surface of the ramp 10. A rigid frame 104 projects downwardly from the underside of the float 12 and straddles the wall 100. Opposite sides of the frame 104, each carry a roller 106 rotatably mounted about a vertical axis which contact the respective side of the wall 100. Consequently, the frame 104 is able to freely slide along the wall 100 while preventing transverse movement of the float 12. The height of the wall 100 is not critical. However, it must be sufficiently high so that the frame 104 remains straddling the wall 100 at all times including high wave conditions. As illustrated in FIG. 7, a second set of rollers 108 is rotatably mounted about a vertical axis at the uphill end of the float 12.

It is apparent that other guide means for preventing transverse movement of the float may also be employed where necessary. For example, a cable may be stretched along the incline of the ramp 10 and terminate at the sinker 52. Single guide rollers connected to the underside of the float 12 by lines could then be mounted on the line to prevent transverse movement of the float while allowing the float to move up and down the ramp 10.

The inventive movable float system is thus capable of greatly facilitating the launching of trailerable boats in bodies of water having widely varying levels without requiring boaters to wade into the water in which the boat is to be launched.

I claim:

1. A movable float system for a boat launching ramp extending into a body of water, comprising:

an elongated float having its longitudinal axis extending along the incline of said ramp;

sheave means positioned adjacent a continuously underwater portion of said ramp;

powered drive means adapted for selectively driving a line in either direction responsive to a control signal;

a line extending from one end of said float to engage said sheave means, from said sheave means to engage said drive means and from said drive means to other end of said float such that actuation of said drive means moves said float along the incline of said ramp; and water level sensing means for generating said control signal responsive to variations in water level so that said float remains on the surface of said water adjacent the water line of said ramp.

2. The movable float system of claim 1, wherein said water level sensing means comprises:

a tube having a lower end position below the low water level of said body of water and an upper end positioned above the high water level of said body of water, said tube communicating with said body of water such that the water level in said tube varies in accordance with the water level at said ramp; and ultra-sound level sensing means mounted in the upper end of said tube facing downwardly toward the lower end of said tube for measuring the level of water in said tube and generating said control signal as said water level varies to move said float along said ramp.

3. The movable float system of claim 2, wherein said tube is substantially vertical and said tube communicates with said body of water adjacent said ramp through an equilizing tube extending between the lower end of said measurement tube and said water.

4. The movable float system of claim 1, further including guide means extending along the incline of such ramp for preventing transverse movement of said float.

5. The movable float system of claim 4, wherein said guide means includes a rail running along the incline of said ramp, a plurality of spaced apart roller means engaging said rail and connecting means extending between said rollers and the lower surface of said float such that said float follows the path of said rail responsive to the water level variations.

6. The movable float system of claim 5, wherein said connecting means includes a pair of lines extending downwardly to each roller means from opposite sides of said float to stabilize said float against transverse movement.

7. The movable float system of claim 6, further including means for adjusting the length of said lines in order to adjust the tension of said lines.

8. The movable float system of claim 6, wherein said rail is formed by an eye-beam having an upper and lower flanges interconnected by a vertically disposed web, and wherein said roller means includes a trolley positioned above and straddling said rail, and a pair of rollers rotatably mounted about a transverse axis on opposite sides of said web with the periphery of said rollers contacting the underside of said upper flange, said trolleys being secured to said float by said connecting means.

9. The movable float system of claim 4, wherein said guide means includes a rigid, vertically disposed wall extending along the incline of said ramp, a frame projecting downwardly from the underside of said float and straddling said wall and a plurality of rollers rotatably mounted on said frame about a vertical axis of rotation on opposite faces of said wall to allow said frame to freely slide along said wall responsive to water level variations.

10. The movable float system of claim 1, wherein said sheave is fastened to a sinker which is in turn, secured to a plurality of anchors for preventing movement of said sheave responsive to forces exerted on said sheave by said line.

11. The movable float system of claim 1, further included an access ramp having one end pivotally secured to the upper edge of the shallow water end of said float and the other end of said access ramp supported on said launching ramp.

12. The movable float system of claim 11, wherein said float moves incrementally in response to water level variations, and the length of said access ramp is at least as long as the product of said increment and the slope of said launching ramp such that said access ramp is capable of bridging water between the shallow water end of said float and the water line of said launching ramp between movements of said float.

13. The movable float system of claim 1, wherein said drive means includes a reversible motor actuated in either direction by said control signal, and a split, two-section drum connected to said motor, the portion of said line connected directly to said float being wound on one of said sections in one direction and the portion of said line means extending to said sheave being wound on the other of said sections in the opposite direction such that rotation of said motor plays out one portion of said line while simultaneously and correspondingly retracting the other portion of said line.

* * * * *